US011390093B2

(12) United States Patent
Ohashi

(10) Patent No.: US 11,390,093 B2
(45) Date of Patent: Jul. 19, 2022

(54) INK JET RECORDING APPARATUS AND INK JET TEXTILE PRINTING METHOD

(71) Applicant: Seiko Epson Corporation, Tokyo (JP)

(72) Inventor: Masakazu Ohashi, Shiojiri (JP)

(73) Assignee: Seiko Epson Corporation

( * ) Notice: Subject to any disclaimer, the term of this patent is extended or adjusted under 35 U.S.C. 154(b) by 124 days.

(21) Appl. No.: 16/831,940

(22) Filed: Mar. 27, 2020

(65) Prior Publication Data

US 2020/0307254 A1 Oct. 1, 2020

(30) Foreign Application Priority Data

Mar. 28, 2019 (JP) ..... JP2019-062409

(51) Int. Cl.
*B41J 3/407* (2006.01)
*B41M 5/00* (2006.01)

(52) U.S. Cl.
CPC ..... *B41J 3/4078* (2013.01); *B41M 5/0023* (2013.01)

(58) Field of Classification Search
CPC ..... C09D 11/322; C09D 11/40; C09D 11/037; D06P 5/30; B41J 2/18
See application file for complete search history.

(56) References Cited

U.S. PATENT DOCUMENTS 10,245,841 B2 4/2019 Asaka et al.
2010/0091052 A1 4/2010 Ogawa et al.
2011/0184108 A1* 7/2011 Okuda ..... C09D 11/322 524/377
2014/0210900 A1 7/2014 Ohashi et al.
2016/0311233 A1 10/2016 Murai et al.
2017/0362450 A1 12/2017 Oriakhi et al.
2018/0015722 A1* 1/2018 Kasai ..... B41J 2/04598
2018/0257386 A1 9/2018 Asaka et al.
2018/0298219 A1* 10/2018 Loccufier ..... C09D 11/38
2019/0160817 A1* 5/2019 Sameshima ..... B41J 2/18
2020/0023648 A1* 1/2020 Gotou ..... B41J 2/2117
2020/0207996 A1* 7/2020 Yatake ..... C09D 11/322

FOREIGN PATENT DOCUMENTS

EP 3351389 A1 7/2018
JP 2009-030014 A 2/2009

* cited by examiner

*Primary Examiner* — John Zimmermann
(74) *Attorney, Agent, or Firm* — Harness, Dickey & Pierce, P.L.C.

(57) ABSTRACT

An ink jet recording apparatus includes an ink composition and a liquid jet head including a nozzle for discharging the ink composition. The ink composition is a textile printing ink composition containing resin particles, a white pigment, and water. The content of the resin particles is 5.0 mass % or more based on the total amount of the ink composition. The content of the white pigment is 5.0 mass % or more based on the total amount of the ink composition. The resin particles have a glass transition temperature of less than 6° C. The liquid jet head includes a pressure chamber to which the ink composition is supplied and a circulation return passage enabling the ink composition in the pressure chamber to circulate.

7 Claims, 3 Drawing Sheets

INK JET RECORDING APPARATUS AND INK JET TEXTILE PRINTING METHOD

The present application is based on, and claims priority from JP Application Serial Number 2019-062409, filed Mar. 28, 2019, the disclosure of which is hereby incorporated by reference herein in its entirety.

BACKGROUND

1. Technical Field

The present disclosure relates to an ink jet recording apparatus and an ink jet textile printing method.

2. Related Art

An ink jet recording method performs recording by discharging small droplets of an ink composition through a fine nozzle such that the ink composition adheres to a recording medium. This method is characterized in that high-resolution and high-quality images can be recorded at high speed with a relatively inexpensive apparatus. The ink jet recording method has numerous factors to consider, including the properties of the ink composition to be used, stability in recording, and the quality of the resulting image, and not only ink jet recording apparatuses but also ink jet inks to be used are actively being studied.

In addition, for example, fabric is dyed (textile printing) by the ink jet recording method. As the textile printing method for fabric (woven fabric or non-woven fabric), for example, a screen textile printing method or a roller textile printing method has been used. However, since the ink jet recording method is advantageous from the viewpoint of multi-type small-quantity productivity and immediate printability, it has been variously studied. For example, ink compositions containing white pigments have been proposed for printing on dark fabric, such as black fabric, or for forming a base for printing (for example, JP-A-2009-30014).

In printing on dark fabric, since the color development properties are inhibited by the base, textile printing is to achieve high whiteness. When an ink composition contains a white pigment at a high concentration for increasing the whiteness of printed fabric, the white pigment tends to precipitate, and the discharge stability of the ink composition tends to be deteriorated.

In addition, as shown in JP-A-2009-30014, the washing fastness properties of printed fabric are increased by adding resin particles to the ink composition. However, when the ink composition contains resin particles, the discharge stability tends to be decreased, and also the touch of the printed portion of the printed fabric becomes hard. Thus, there is a problem from the viewpoint of texture.

SUMMARY

The present inventors have diligently studied to solve the problem above. As a result, it was found that when a combination of a jet head including a predetermined circulation return passage and a predetermined textile printing ink composition is used, printed matter having excellent washing fastness properties and texture can be obtained with excellent discharge stability of the ink composition while having high whiteness.

That is, the present disclosure relates to an ink jet recording apparatus that includes an ink composition and a liquid jet head including a nozzle for discharging the ink composition, in which the ink composition is a textile printing ink composition containing resin particles, a white pigment, and water and contains the resin particles in an amount of 5.0 mass % or more based on the total amount of the ink composition and the white pigment in an amount of 5.0 mass % or more based on the total amount of the ink composition, the resin particles have a glass transition temperature of less than 6° C., and the liquid jet head includes a pressure chamber to which the ink composition is supplied and a circulation return passage enabling the ink composition in the pressure chamber to circulate.

The present disclosure also relates to an ink jet textile printing method using an ink jet recording apparatus that includes a liquid jet head including a nozzle for discharging an ink composition, a pressure chamber to which the ink composition is supplied and a circulation return passage enabling the ink composition in the pressure chamber to circulate, the method including discharging the ink composition from the nozzle and circulating at least a part of the ink composition into the pressure chamber from the circulation return passage, in which the ink composition is a textile printing ink composition containing resin particles, a white pigment, and water and contains the resin particles in an amount of 5.0 mass % or more based on the total amount of the ink composition and the white pigment in an amount of 5.0 mass % or more based on the total amount of the ink composition, and the resin particles have a glass transition temperature of less than 6° C.

In the above-described ink jet recording apparatus and ink jet textile printing method, the resin particles may have a glass transition temperature of −25° C. or more and less than 6° C., the ink composition may contain the white pigment in an amount of 6.0 mass % or more based on the total amount of the ink composition, the solid content concentration in the ink composition may be 12 mass % or more, and the resin particles may contain a urethane resin.

DESCRIPTION OF EXEMPLARY EMBODIMENTS

Figure 1:
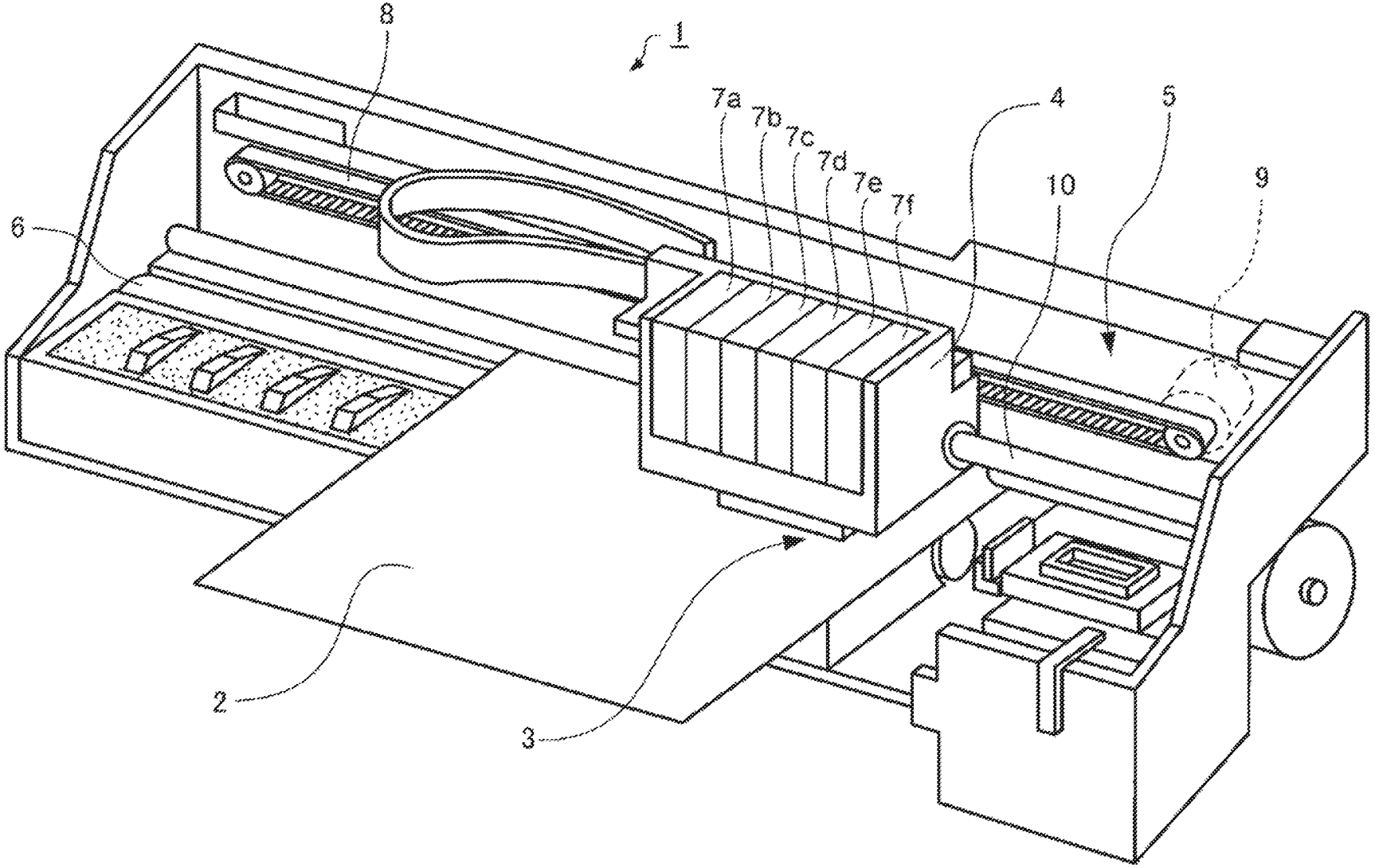
FIG. 1 is a schematic perspective view of an ink jet recording apparatus according to an embodiment.

Embodiments (hereinafter, referred to as "the present embodiment") of the present disclosure will now be described in detail with reference to the drawings as needed, but the present disclosure is not limited thereto and can be variously modified within a range not departing from the gist thereof. In the drawings, the same elements are denoted by the same reference numerals, and redundant description is omitted. The positional relationship, such as up and down and right and left, is based on the positional relationship shown in the drawings unless otherwise specified. The dimensional ratios in the drawings are not limited to the illustrated ratios.

Ink Jet Recording Apparatus

The ink jet recording apparatus of the present embodiment includes an ink composition and a liquid jet head including a nozzle for discharging the ink composition. The ink composition is a textile printing ink composition containing resin particles, a white pigment, and water and contains the resin particles in an amount of 5.0 mass % or more based on the total amount of the ink composition, the white pigment in an amount of 5.0 mass % or more based on the total amount of the ink composition. The resin particles have a glass transition temperature of less than 6° C. The liquid jet head includes a pressure chamber to which the ink composition is supplied and a circulation return passage enabling the ink composition in the pressure chamber to circulate. According to the above configuration, it is possible to provide an ink jet recording apparatus that gives printed matter having excellent washing fastness properties and texture with excellent discharge stability of the ink composition while giving high whiteness.

The definition of each term in the present disclosure will be described. The term "circulation return passage" means a flow channel that is different from the ink composition flow channel for supplying the ink composition from the pressure chamber to the nozzle and is a flow channel for returning the supplied ink composition to the pressure chamber. The term "(meth)acrylic acid" means acrylic acid or methacrylic acid. Similarly, the term "(meth)acryl" means acryl or methacryl.

The ink jet recording apparatus of the present embodiment may include a process liquid adhesion mechanism for treating fabric as an object of textile printing or may be an ink jet recording system including a process liquid adhesion mechanism provided separately from the ink jet recording apparatus. In addition, in the present embodiment, the process liquid adhesion mechanism is not an indispensable component.

The process liquid adhesion mechanism is not particularly limited, and examples thereof include (a) an ink jet application apparatus discharging an ink composition from a nozzle of a liquid jet head for the discharge, (b) an immersion apparatus for immersing fabric in a process liquid composition, (c) a roller application apparatus for applying a process liquid composition with, for example, a roll coater, and (d) a spray apparatus jetting a process liquid composition. Among these apparatuses, the ink jet application apparatus may be used because it allows uniform adhesion of a process liquid composition to fabric.

The ink jet recording apparatus of the present embodiment may be an on-carriage type printer in which an ink cartridge is loaded on a carriage or an off-carriage type printer in which an ink cartridge is disposed to the outside. Incidentally, the ink jet recording apparatus of the present embodiment will now be described using an on-carriage type printer as an example.

The ink jet recording apparatus of the present embodiment may be a serial printer or may be a line printer. The serial printer includes a liquid jet head loaded on a carriage that moves in a predetermined direction and is a printer of a system in which the liquid jet head moves according to the movement of the carriage and discharges droplets on a recording medium. The line printer includes a liquid jet head formed to be wider than the width of recording media and is a printer of a system in which the liquid jet head discharges droplets on a recording medium without moving. Incidentally, the ink jet recording apparatus of the present embodiment will now be described using a serial printer as an example.

The ink jet recording apparatus is an apparatus for performing textile printing by landing droplets on fabric with a liquid jet head as a liquid discharge section for discharging micro-droplets of an ink composition. FIG. 1 is a schematic perspective view illustrating an ink jet recording apparatus of the present embodiment.

As shown in FIG. 1, the printer 1 according to the present embodiment includes a liquid jet head 3, a carriage 4, a main scanning mechanism 5, a platen roller 6, and a controller (not shown) for controlling the operation of the whole printer 1. The carriage 4 carries the liquid jet head 3 and detachably carries ink cartridges 7*a*, 7*b*, 7*c*, 7*d*, 7*e*, and 7*f* containing ink compositions to be supplied to the liquid jet head 3.

The main scanning mechanism 5 includes a timing belt 8 connected to the carriage 4, a motor 9 for driving the timing belt 8, and a guide shaft 10. The guide shaft 10 lays as a supporting member for the carriage 4 in the scanning direction of the carriage 4, i.e., in the main scanning direction. The carriage 4 is driven by the motor 9 via the timing belt 8 and can be reciprocated along the guide shaft 10. Consequently, the main scanning mechanism 5 has a function of reciprocating the carriage 4 in the main scanning direction.

The platen roller 6 has a function of transporting fabric 2 for textile printing in a sub-scanning direction orthogonal to the main scanning direction, i.e., in the longitudinal direction of the fabric 2. Consequently, the fabric 2 is transported in the sub-scanning direction. It is configured such that the carriage 4 carrying the liquid jet head 3 can be reciprocated in the main scanning direction which is approximately corresponds to the width direction of the fabric 2 and that the liquid jet head 3 can relatively scan the fabric 2 in the main scanning direction and the sub-scanning direction.

The ink cartridges 7*a*, 7*b*, 7*c*, 7*d*, 7*e*, and 7*f* are independent six ink cartridges. The ink cartridges 7*a*, 7*b*, 7*c*, 7*d*, 7*e*, and 7*f* can contain ink compositions constituting an ink set. These ink cartridges individually contain ink compositions having colors, such as black, cyan, magenta, yellow, white, and orange, in an arbitrary combination. In FIG. 1, the number of ink cartridges is six but is not limited thereto. The bottoms of the ink cartridges 7*a*, 7*b*, 7*c*, 7*d*, 7*e*, and 7*f* are provided with supply ports (not shown) for supplying the ink compositions contained in the respective ink cartridges to the liquid jet head 3. In addition, when the process liquid adhesion mechanism performs ink jet application, one of the ink cartridges 7*a*, 7*b*, 7*c*, 7*d*, 7*e*, and 7*f* can contain a process liquid.

The liquid jet head 3 is a means for jetting ink compositions supplied from the ink cartridges 7*a*, 7*b*, 7*c*, 7*d*, 7*e*, and 7*f* to fabric 2 from multiple nozzles N under control by the controller (not shown) so that the ink compositions adhere to the fabric 2. The liquid jet head 3 includes multiple nozzles (see FIG. 2) on the side facing fabric 2 to which ink compositions adhere, the nozzles discharging the ink compositions so that the ink compositions adhere to the fabric 2. These nozzles are arranged to form nozzle lines, and the nozzle lines are individually arranged to correspond to the respective color ink compositions and the process liquid. The ink compositions are supplied to the liquid jet head 3 from the respective ink cartridges and are discharged as droplets from the nozzles by actuators (not shown) in the liquid jet head 3. The discharged droplets of the ink compositions and the process liquid land on the fabric 2 to pretreat the fabric 2 and to form an image, text, pattern, color, etc. by the ink compositions in the textile printing region of the fabric 2.

Here, the liquid jet head 3 uses a piezoelectric element as the actuator serving as a driving mechanism but is not limited to this system. For example, an electromechanical conversion element that displaces a diaphragm as the actuator by electrostatic adsorption or an electrothermal conversion element that discharges an ink composition as droplets by air bubbles generated by heating may be used.

The liquid jet head 3 in the present embodiment is a head having a circulation passage for circulating the ink composition. When the liquid jet head 3 includes a circulation passage, the ink composition in the pressure chamber or nozzle flows to inhibit clogging due to aggregates of resin particles and to improve the discharge stability. Consequently, even if an ink composition that tends to generate foreign matter is used, it is possible to provide an ink jet recording method with excellent discharge stability.

Figure 2:
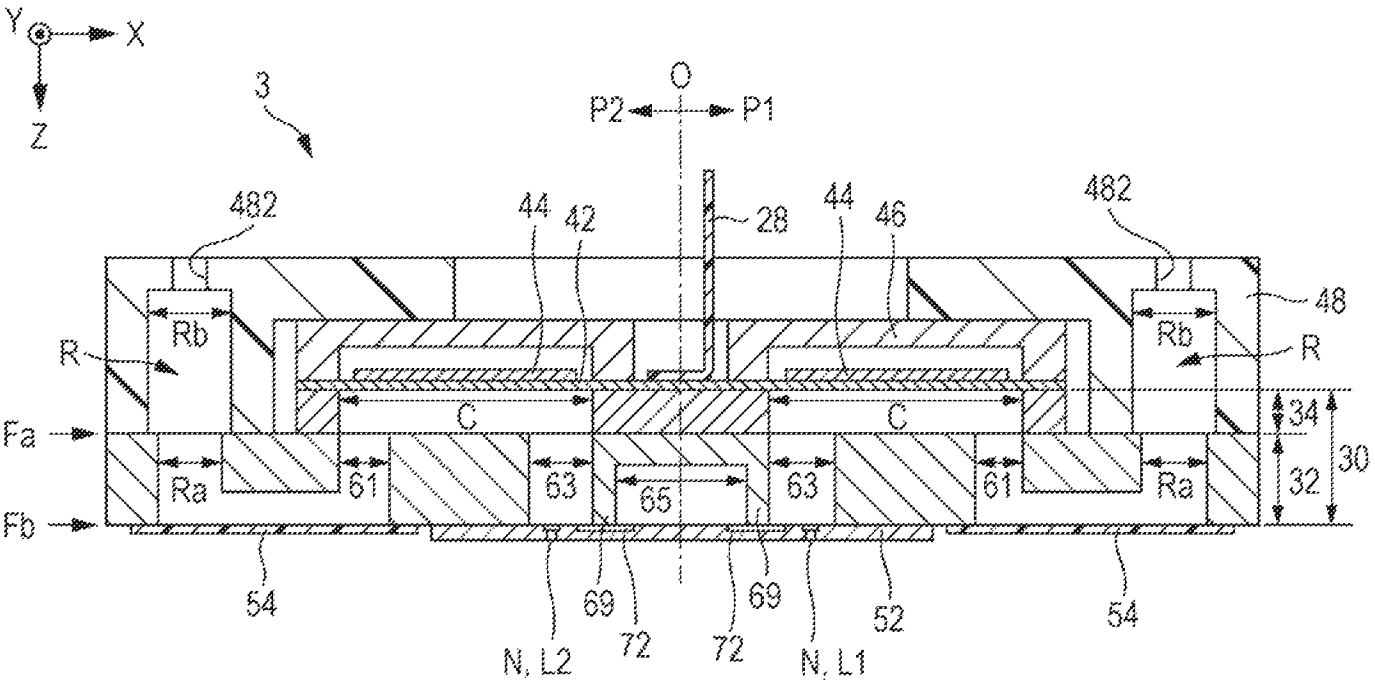
FIG. 2 is a cross-sectional view of a liquid jet head.
Figure 3:
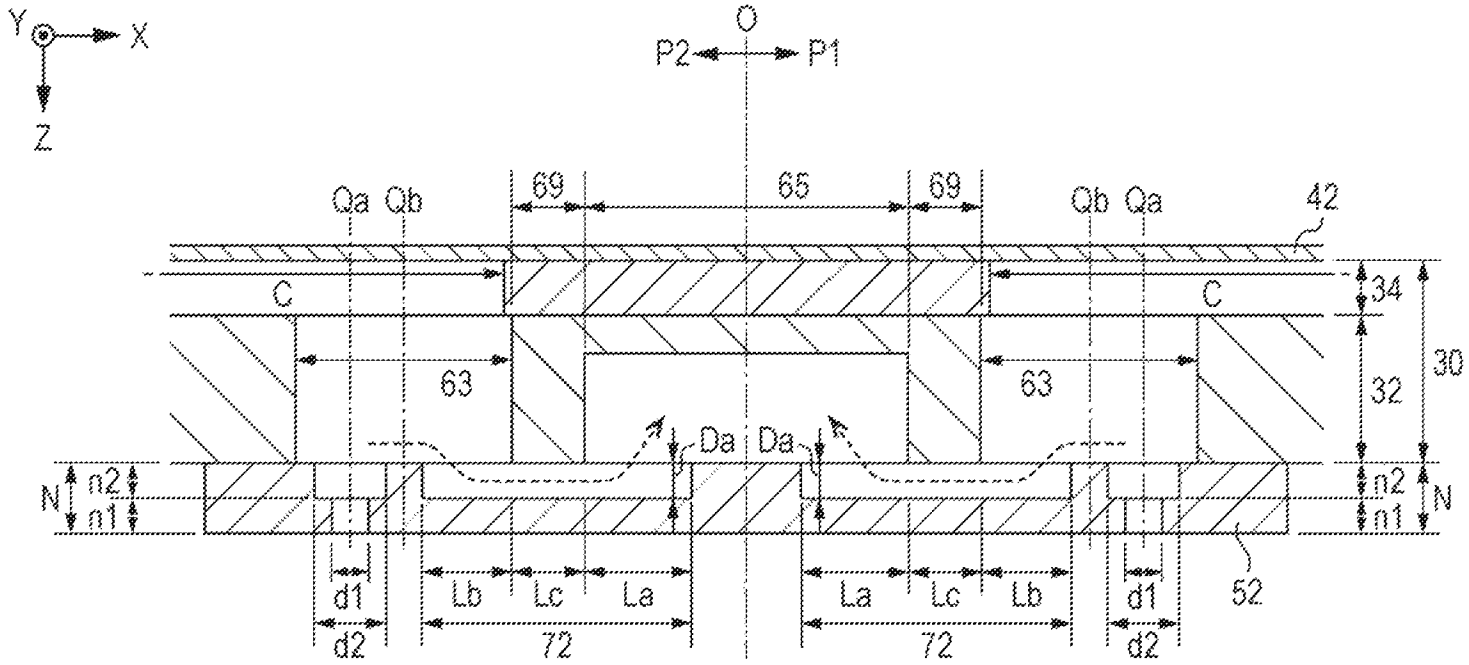
FIG. 3 is a cross-sectional view of a vicinity of a circulation liquid chamber in the liquid jet head.

FIG. 2 is a cross-sectional view of the liquid jet head 3 in a cross-section perpendicular to the Y-direction, and FIG. 3 is a partial exploded perspective view of the liquid jet head 3. In FIG. 2, for example, a plane parallel to the surface of the fabric 2 is referred to as an X-Y plane, and a direction perpendicular to the X-Y plane is referred to as a Z direction hereinafter. The jet direction of the ink composition by the liquid jet head 3 corresponds to the Z direction. The main scanning direction corresponds to the X direction, and a direction (sub-scanning direction) orthogonal to the main scanning direction corresponds to the Y direction.

The multiple nozzles N of the liquid jet head 3 are arranged in the Y direction to constitute a nozzle line. In the liquid jet head 3, a plane passing through a central axis parallel to the Y direction and being parallel to the Z direction, i.e., the Y-Z plane O is referred to as "central plane" in the following description.

As shown in FIG. 2, the liquid jet head 3 has a configuration in which elements related to each nozzle N of a first line L1 and elements related to each nozzle N of a second line L2 are arranged plane-symmetrically with respect to the central plane O. That is, in the liquid jet head 3, the configuration of the portion on the positive side (hereinafter, also referred to as "first portion") P1 in the X direction and the configuration of the portion on the negative side (hereinafter, also referred to as "second portion") P2 in the X direction are substantially the same with respect to the central plane O. The multiple nozzles N of the first line L1 are formed in the first portion P1, and the multiple nozzles N of the second line L2 are formed in the second portion P2. The central plane O corresponds to the interface between the first portion P1 and the second portion P2.

As shown in FIG. 2, the liquid jet head 3 includes a flow channel forming portion 30. The flow channel forming portion 30 is a structure that forms a flow channel for supplying an ink composition to multiple nozzles N. In the present embodiment, the flow channel forming portion 30 is constituted by lamination of a first flow channel substrate 32 and a second flow channel substrate 34. The first flow channel substrate 32 and the second flow channel substrate are each a plate-like member being long in the Y direction. The second flow channel substrate 34 is disposed on the surface Fa of the first flow channel substrate 32 on the negative side in the Z direction with, for example, an adhesive.

As shown in FIG. 2, in addition to the second flow channel substrate 34, a vibrating portion 42, multiple piezoelectric elements 44, a protection member 46, and a housing 48 are disposed on the surface Fa of the first flow channel substrate 32. On the other hand, on the positive side of the first flow channel substrate 32 in the Z direction, i.e., on the surface Fb on the opposite side to the surface Fa, a nozzle plate 52 and a vibration absorber 54 are disposed. The elements of the liquid jet head 3 are each schematically a plate-like member being long in the Y direction, as in the first flow channel substrate 32 and the second flow channel substrate 34, and are bonded to each other with, for example, an adhesive. It is also possible to comprehend that the Z direction is a direction in which the first flow channel substrate 32 and the second flow channel substrate 34 are stacked, a direction in which the first flow channel substrate 32 and the nozzle plate 52 are stacked, or a direction perpendicular to the surface of each plate-like element.

The nozzle plate 52 is a plate-like member provided with multiple nozzles N and is disposed on the surface Fb of the first flow channel substrate 32 with, for example, an adhesive. Each of the nozzles N is a circular through hole for passing an ink composition therethrough. In the nozzle plate 52 of the present embodiment, multiple nozzles N constituting a first line L1 and multiple nozzles N constituting a second line L2 are formed. Specifically, the multiple nozzles N of the first line L1 are formed along the Y direction in a region on the positive side of the nozzle plate 52 in the X direction when viewed from the central plane O, and the multiple nozzles N of the second line L2 are formed along the Y direction in a region on the negative side in the X direction. The nozzle plate 52 is a single plate-like member continuing over the portion where the multiple nozzles N of the first line L1 are formed and the portion where the multiple nozzles N of the second line L2 are formed. The nozzle plate 52 is manufactured by a semiconductor manufacturing technique, for example, by processing a single-crystal substrate of silicon by a processing technique, such as dry etching or wet etching. However, known materials and manufacturing methods can be arbitrarily employed for manufacturing the nozzle plate 52.

As shown in FIG. 2, the first flow channel substrate 32 is provided with a space Ra, multiple supply channels 61, and multiple communication passages 63 formed in each of the first portion P1 and the second portion P2. The space Ra is an opening being long along the Y direction in a planar view, i.e., when viewed from the Z direction, and the supply channels 61 and the communication passages 63 are through holes formed for each nozzle N. The multiple communication passages 63 are arranged in the Y direction in a planar view, and the multiple supply channels 61 are arranged between the array of the multiple communication passages 63 and the space Ra in the Y direction. The multiple supply channels 61 communicate in common with the space Ra. In addition, one arbitrary communication passage overlaps a nozzle N corresponding to the communication passage 63 in a planar view. Specifically, one arbitrary communication passage 63 in the first portion P1 communicates with one nozzle N corresponding to the communication passage 63 in the first line L1. Similarly, one arbitrary communication passage 63 in the second portion P2 communicates with one nozzle N corresponding to the communication passage 63 in the second line L2.

As shown in FIG. 2, the second flow channel substrate 34 is a plate-like member provided with multiple pressure chambers C in each of the first portion P1 and the second portion P2. The multiple pressure chambers C are arranged in the Y direction. The pressure chambers C are spaces being long along the X direction in a planar view formed for the respective nozzles N. The first flow channel substrate 32 and the second flow channel substrate 34 are manufactured by, for example, processing a single-crystal substrate of silicon by a semiconductor manufacturing technique, as in the above-described nozzle plate 52. However, known materials and manufacturing methods can be arbitrarily employed for manufacturing the first flow channel substrate 32 and the second flow channel substrate 34. As exemplified above, the flow channel forming portion and the nozzle plate 52 in the present embodiment encompass substrates made of silicon. Accordingly, for example, there is an advantage that minute flow channels can be formed with high precision in the flow channel forming portion 30 and the nozzle plate 52 by using the semiconductor manufacturing technique as exemplified above.

As shown in FIG. 2, a vibrating portion 42 is disposed on the surface of the second flow channel substrate 34 on the opposite side to the first flow channel substrate 32. The vibrating portion 42 of the present embodiment is a plate-like member capable of elastically vibrating. Incidentally, the second flow channel substrate 34 and the vibrating portion 42 can also be integrally formed by selectively removing a part of the plate-like member having a predetermined thickness in the thickness direction in the region corresponding to the pressure chamber C.

As shown in FIG. 2, the surface Fa of the first flow channel substrate 32 and the vibrating portion 42 face each other with an interval therebetween in the inside of each pressure chamber C. The pressure chamber C is a space located between the surface Fa of the first flow channel substrate 32 and the vibrating portion 42 and generates a change in the pressure of the ink composition filled in the space. Each pressure chambers C is a space whose longitudinal direction is, for example, the X direction, and is formed for each nozzle N. In each of the first line L1 and the second line L2, multiple pressure chambers C are arranged in the Y direction. As shown in FIG. 2, the end of one arbitrary pressure chamber C on the central plane O side overlaps the communication passage 63 in a planar view, and the end on the opposite side to the central plane O overlaps the supply channel 61 in a planar view. Accordingly, in each of the first portion P1 and the second portion P2, the pressure chamber C is communicated with the nozzle N through the communication passage 63 and is also communicated with the space Ra through the supply channel 61. Incidentally, it is also possible to add a predetermined flow channel resistance by forming a throttle flow channel having a narrowed flow channel width in the pressure chamber C.

As shown in FIG. 2, on the surface of the vibrating portion 42 on the opposite side to the pressure chamber C, multiple piezoelectric elements 44 corresponding to the respective different nozzles N are disposed in each of the first portion P1 and the second portion P2. The piezoelectric elements 44 are passive elements that are deformed by supply of a driving signal. The multiple piezoelectric elements 44 are arranged in the Y direction so as to correspond to the respective pressure chambers C. One arbitrary piezoelectric element 44 is, for example, a laminate composed of two electrodes facing each other with a piezoelectric layer therebetween. Incidentally, it is also possible to define the portion being deformed by supply of a driving signal, i.e., an active portion vibrating the vibrating portion 42, as the piezoelectric element 44. In the present embodiment, the vibration of the vibrating portion 42 due to the deformation of the piezoelectric elements 44 changes the pressure in the pressure chamber C, and consequently, the ink composition filling the pressure chamber C passes through the communication passage 63 and the nozzle N and is jetted.

The protection member 46 in FIG. 2 is a plate-like member for protecting the multiple piezoelectric elements 44 and is disposed on the surface of the vibrating portion 42 or the surface of the second flow channel substrate 34. Although the material and the manufacturing method for the protection member 46 are arbitrary, the protection member 46 may be formed by, for example, processing a single-crystal substrate of silicon by a semiconductor manufacturing technique as in the first flow channel substrate 32 and the second flow channel substrate 34. The multiple piezoelectric elements 44 can be accommodated in recesses formed on the surface of the protection member 46 on the vibrating portion 42 side.

An end of a wiring substrate 28 is bonded to the surface of the vibrating portion 42 on the opposite side to the flow channel forming portion 30 or the surface of the flow channel forming portion 30. The wiring substrate 28 is a flexible mounting part in which multiple wirings (not shown) electrically connecting a control unit 20 and a liquid jet head 3 are formed. An end of the wiring substrate 28 passes through an opening formed in the protection member 46 and an opening formed in the housing 48, extends to the outside, and is connected to the control unit 20. For example, a flexible printed circuit (FPC) or a flexible flat cable (FFC) may be used as the flexible wiring substrate 28.

The housing 48 is a case for storing the ink composition that is supplied to the multiple pressure chambers C and further to the multiple nozzles N. The surface of the housing 48 on the positive side in the Z direction is bonded to the surface Fa of the first flow channel substrate 32 with, for example, an adhesive. In manufacturing of the housing 48, a known technique or a manufacturing method can be arbitrarily employed. For example, the housing 48 can be formed by injection molding of a resin material.

As shown in FIG. 2, a space Rb is formed in each of the first portion P1 and the second portion P2 in the housing 48. The space Rb in the housing 48 and the space Ra in the first flow channel substrate 32 are communicated with each other. The space formed from the space Ra and the space Rb functions as a liquid storage chamber R for storing the ink composition that is supplied to the multiple pressure chambers C. The liquid storage chamber R is a common liquid chamber shared with the multiple nozzles N. The first portion P1 and the second portion P2 are each provided with the liquid storage chamber R. The liquid storage chamber R of the first portion P1 is located on the positive side in the X direction when viewed from the central plane O, and the liquid storage chamber R of the second portion P2 is located on the negative side in the X direction when viewed from the central plane O. An inlet port 482 for introducing the ink composition supplied from a liquid container 14 to the liquid storage chamber R is formed on the surface of the housing 48 on the opposite side to the first flow channel substrate 32.

A vibration absorber 54 is disposed on the surface Fb of the first flow channel substrate 32 in each of the first portion P1 and the second portion P2. The vibration absorber 54 is a flexible film that absorbs a change in the pressure of the ink composition in the liquid storage chamber R, i.e., a compliance substrate. For example, the vibration absorber 54 is disposed on the surface Fb of the first flow channel substrate 32 to configure a wall, specifically, the bottom of the liquid storage chamber R and occludes the space Ra of the first flow channel substrate 32 and the multiple supply channels 61.

A space (hereinafter, referred to as "circulation liquid chamber") 65 is formed on the surface Fb of the first flow channel substrate 32 facing the nozzle plate 52. The circulation liquid chamber 65 of the present embodiment is a long bottomed hole extending in the Y direction in a planar view. The opening of the circulation liquid chamber 65 is occluded by the nozzle plate 52 bonded to the surface Fb of the first flow channel substrate 32. The circulation liquid chamber 65 continues, for example, over the multiple nozzles N along the first line L1 and the second line L2. Specifically, the circulation liquid chamber 65 is formed between the arrangement of the multiple nozzles N of the first line L1 and the arrangement of the multiple nozzles N of the second line L2. Accordingly, the circulation liquid chamber 65 is located between the communication passages 63 of the first portion P1 and the communication passages 63 of the second portion P2. Thus, the flow channel forming portion 30 is a structure formed of the pressure chambers C and the communication passages 63 in the first portion P1, the pressure chambers C and the communication passages 63 in the second portion P2, and the circulation liquid chamber 65 located between the communication passages 63 in the first portion P1 and the communication passages 63 in the second portion P2. As shown in FIG. 2, the flow channel forming portion 30 includes a wall-like portion (hereinafter, referred to as "partition wall portion") 69 that partitions between the circulation liquid chamber 65 and each of the communication passages 63.

Incidentally, as described above, multiple pressure chambers C and multiple piezoelectric elements 44 are arranged in the Y direction in each of the first portion P1 and the second portion P2. Accordingly, it can be also expressed that the circulation liquid chamber 65 extends in the Y direction to continue over the multiple pressure chambers C or the multiple piezoelectric elements 44 in each of the first portion P1 and the second portion P2. In addition, as shown in FIG. 2, it is also possible to express that the circulation liquid chamber 65 and the liquid storage chamber R extend in the Y direction with an interval therebetween and that the pressure chamber C, the communication passage 63, and the nozzle N are located in the interval.

FIG. 3 is a partial exploded cross-sectional view of a vicinity of the circulation liquid chamber 65 in the liquid jet head 3. As shown in FIG. 3, one nozzle N in the present embodiment includes a first section n1 and a second section n2. The first section n1 and the second section n2 are circular spaces coaxially formed and communicating with each other. The second section n2 is located on the flow channel forming portion 30 side when viewed from the first section n1. In the present embodiment, the central axis Qa of each nozzle N is located on the opposite side to the circulation liquid chamber 65 when viewed from the central axis Qb of the communication passage 63. The inner diameter d2 of the second section n2 is larger than the inner diameter d1 of the first section n1. As described above, a structure in which the nozzles N are formed in a step like shape has an advantage that the flow channel resistance of each nozzle N can be easily set to desired characteristics. In the present embodiment, the central axis Qa of each nozzle N is located on the opposite side to the circulation liquid chamber 65 when viewed from the central axis Qb of the communication passage 63.

As shown in FIG. 3, multiple exhaust passages 72 are formed on the surface of the nozzle plate 52 facing the flow channel forming portion 30 in each of the first portion P1 and the second portion P2. The multiple exhaust passages of the first portion P1 correspond one-to-one to the multiple nozzles N of the first line L1 or to the multiple communication passages 63 corresponding to the first line L1. In addition, the multiple exhaust passages 72 of the second portion P2 correspond one-to-one to the multiple nozzles N of the second line L2 or the multiple communication passages 63 corresponding to the second line L2.

Each of the exhaust passages 72 is a groove extending in the X direction, i.e., a long bottomed hole, and functions as a flow channel for distributing an ink composition. The exhaust passage 72 of the present embodiment is formed at a position separated from the nozzles N, specifically, on the circulation liquid chamber 65 side when viewed from the nozzle N corresponding to the exhaust passage 72. For example, the multiple nozzles N, especially, the second section n2, and the multiple exhaust passages 72 are collectively formed by a common process by a semiconductor manufacturing technique, for example, a processing technique such as dry etching or wet etching.

Each of the exhaust passages 72 is linearly formed with a flow channel width Wa equivalent to the inner diameter d2 of the nozzle N in the second section n2. In addition, the flow channel width Wa of the exhaust passage in the present embodiment is smaller than the flow channel width Wb of the pressure chamber C. Accordingly, it is possible to increase the flow channel resistance of the exhaust passage 72, compared to the configuration in which the flow channel width Wa of the exhaust passage 72 is larger than the flow channel width Wb of the pressure chamber C. On the other hand, the depth Da of the exhaust passage 72 from the surface of the nozzle plate 52 is constant over the whole length. Specifically, the exhaust passages 72 are each formed with a depth equivalent to the depth of the second section n2 of the nozzle N. The configuration described above has an advantage that the exhaust passages 72 and the second section n2 are easily formed, compared to the configuration in which the exhaust passages 72 and the second section n2 are formed with different depths from each other. Incidentally, the "depth" of the flow channel means the depth of the flow channel in the Z direction, for example, the difference in height between the flow channel-forming surface and the bottom of the flow channel.

One arbitrary exhaust passage 72 in the first portion P1 is located on the circulation liquid chamber 65 side when viewed from the nozzle N corresponding to the exhaust passage 72 in the first line L1. In addition, one arbitrary exhaust passage 72 in the second portion P2 is located on the circulation liquid chamber 65 side when viewed from the nozzle N corresponding to the exhaust passage 72 in the second line L2. The opposite side to the central plane O of each exhaust passage 72 overlaps one communication passage 63 corresponding to the exhaust passage 72 in a planar view. That is, the exhaust passages 72 are communicated with the communication passages 63. On the other hand, the end of each exhaust passage 72 on the central plane O side overlaps the circulation liquid chamber 65 in a planar view. That is, the exhaust passages 72 are communicated with the circulation liquid chamber 65. Thus, the multiple communication passages 63 are each communicated with the circulation liquid chamber 65 through the respective exhaust passages 72. Accordingly, as indicated by the dashed line arrows in FIG. 3, the ink composition in each of the communication passages 63 is supplied to the circulation liquid chamber 65 through the exhaust passages 72. That is, in the present embodiment, the multiple communication passages 63 corresponding to the first line L1 and the multiple communication passages 63 corresponding to the second line L2 are communicated in common with one circulation liquid chamber 65.

FIG. 3 illustrates the flow channel length La of one arbitrary exhaust passage 72 in the part overlapping the circulation liquid chamber 65, the flow channel length, i.e., the size Lb in the X direction, of the exhaust passage 72 in the part overlapping the communication passages 63, and the flow channel length, i.e., the size Lc in the X direction, of the exhaust passage 72 in the part overlapping the partition wall portion 69 of the flow channel forming portion 30. The flow channel length Lc corresponds to the thickness of the partition wall portion 69. The partition wall portion 69 functions as a throttle portion of the exhaust passage 72. Accordingly, the flow channel resistance of the exhaust passage 72 increases with the flow channel length Lc corresponding to the thickness of the partition wall portion 69. In the present embodiment, there is a relationship that the flow channel length La is longer than the flow channel length Lb and is longer than the flow channel length Lc. Furthermore, in the present embodiment, there is a relationship that the flow channel length Lb is longer than the flow channel length Lc. According to the configuration described above, there is an advantage that an ink composition easily flows into the circulation liquid chamber 65 from the communication passage 63 through the exhaust passage 72, compared to a configuration in which the flow channel length La and the flow channel length Lb are shorter than the flow channel length Lc.

As described above, in the liquid jet head 3, the pressure chamber C is indirectly communicated with the circulation liquid chamber 65 through the communication passage 63 and the exhaust passage 72. That is, the pressure chamber C and the circulation liquid chamber 65 are not directly communicated with each other. In the configuration described above, when the pressure in the pressure chamber C changes by the action of the piezoelectric element 44, a part of the ink composition flowing in the communication passage 63 is jetted from the nozzle N to the outside, and a part of the remaining ink composition flows into the circulation liquid chamber 65 from the communication passage 63 through the exhaust passage 72. The inertances of the communication passage 63, the nozzle, and the exhaust passage 72 are selected such that the amount of the ink composition jetted through the nozzle N by one-time driving of the piezoelectric element 44 from the ink composition flowing in the communication passage 63 is larger than the amount of the ink composition flowing into the circulation liquid chamber 65 through the exhaust passage 72 from the ink composition flowing in the communication passage 63. Assuming that all the piezoelectric elements 44 are driven at once, it can be also expressed that the sum of the circulating amounts flowing into the circulation liquid chamber 65 from the multiple communication passages 63, for example, the flow amount per unit time in the circulation liquid chamber 65, is larger than the sum of the amounts jetted by the multiple nozzles N.

Specifically, the flow channel resistances of the communication passage 63, the nozzle, and the exhaust passage 72 are determined such that the rate of the circulating amount of the ink composition based on the amount of the ink composition flowing in the communication passage 63 is 70% or more, that is, the rate of the jetted amount of the ink composition is 30% or less. According to the configuration described above, the ink composition in the vicinity of a nozzle can be effectively circulated in the circulation liquid chamber 65, while securing the jetted amount of the ink composition. Schematically, the circulating amount decreases but the jetted amount increases with an increase in the flow channel resistance of the exhaust passage 72, in other words, the circulating amount increases but the jetted amount decreases with a decrease in the flow channel resistance of the exhaust passage 72.

For example, the printer 1 has a structure including a circulation mechanism (not shown). The circulation mechanism is a mechanism for supplying the ink composition in the circulation liquid chamber 65 to the liquid storage chamber R, i.e., circulating the ink composition. The circulation mechanism includes, for example, a suction mechanism for sucking the ink composition from the circulation liquid chamber 65, such as a pump, a filter mechanism (not shown) for collecting bubbles and foreign matter mixed in the ink composition, and a heating mechanism for heating the ink composition to reduce the thickening. The ink composition in which bubbles and foreign matter are removed and the thickening is reduced by the circulation mechanism is supplied to the liquid storage chamber R from the circulation mechanism through the inlet port 482. Consequently, the ink composition circulates through a route of liquid storage chamber R→supply channel 61→pressure chamber C→communication passage 63→exhaust passage 72→circulation liquid chamber 65→circulation mechanism→inlet port 482→liquid storage chamber R. The supply channel 61 and the exhaust passage 72 are collectively referred to as a circulation passage. In the route, the path of communication passage 63→exhaust passage 72→circulation liquid chamber 65→circulation mechanism→inlet port 482 corresponds to the circulation return passage.

Thus, when the exhaust passage 72 communicating between the communication passage 63 and the circulation liquid chamber 65 is formed in the nozzle plate 52, the ink composition in the vicinity of a nozzle N can be efficiently circulated in the circulation liquid chamber 65. In addition, since the communication passage 63 corresponding to the first line L1 and the communication passage 63 corresponding to the second line L2 are communicated in common with the circulation liquid chamber 65 between the both, there is also an advantage that the configuration of the liquid jet head is simplified and consequently can be miniaturized, compared to a configuration in which the circulation liquid chamber communicating with each of the exhaust passages 72 corresponding to the first line L1 and the circulation liquid chamber communicating with each of the exhaust passages 72 corresponding to the second line L2 are separately disposed.

In addition, the exhaust passage 72 and the nozzle N are not separated from each other and may be continuous with each other. Alternatively, in addition to the circulation liquid chamber 65, circulation liquid chambers respectively corresponding to the first portion P1 and the second portion P2 may be formed.

In the present embodiment, the printer 1 may include a drying mechanism or a heating mechanism (both are not shown). The drying mechanism and the heating mechanism are mechanisms for efficiently drying the process liquid or the ink composition adhered to fabric 2 in the ink jet recording method described below. The drying mechanism and the heating mechanism may be disposed at any position allowing the fabric 2 to be dried or heated. In order to efficiently dry the ink composition or the process liquid adhered to the fabric 2, for example, in an example shown in FIG. 1, the drying mechanism and the heating mechanism can be disposed at a position facing the liquid jet head 3.

Examples of the drying mechanism and the heating mechanism include a print heater mechanism of bringing the fabric 2 into contact with a heat source for heating, a mechanism of irradiating the fabric 2 with, for example, infrared rays or microwaves that are electromagnetic waves having a maximum wavelength of about 2,450 MHz, and a dryer mechanism of blowing warm air to the fabric 2. Heating of the fabric 2 is performed before or at the time when droplets discharged from the nozzles of the liquid jet head 3 adhere to the fabric 2. Various conditions for heating, for example, timing of heating implementation, heating temperature, and heating time, are controlled by a controller.

The drying mechanism and the heating mechanism may be disposed on the downstream side in the transportation direction of the fabric 2. In such a case, an image is formed by adhesion of the ink composition and the process liquid discharged from nozzles to fabric 2, and the fabric 2 is then heated. Consequently, the drying properties of the ink composition and the process liquid adhered to the fabric 2 are improved.

As described above, in the ink jet recording apparatus of the present embodiment, the liquid discharge section has a configuration including a pressure chamber and a circulation passage for circulating the ink composition in the pressure chamber, and the ink composition in the pressure chamber and the nozzle flows. Consequently, clogging due to aggregates of, for example, the resin particles in the ink composition is inhibited, and the discharge stability in the ink jet recording method described below can be improved.

Ink Composition

The ink composition of the present embodiment is a textile printing ink composition containing resin particles, a white pigment, and water.

The ink composition according to the present embodiment may be an aqueous ink composition. Here, the term "aqueous ink composition" refers to an ink composition in which the content of water is 30 mass % or more based on the total amount of the ink composition.

Resin Particles

The resin particles used in the present embodiment have a glass transition temperature of less than 6° C. When the glass transition temperature is less than 6° C., excellent discharge stability and excellent texture of printed fabric are obtained.

The glass transition temperature (Tg) may be 5° C. or less.

In addition, the glass transition temperature (Tg) may be −25° C. or more, −20° C. or more, −10° C. or more, or 0° C. or more from the viewpoint of further improving the washing fastness properties.

The glass transition temperature is a value obtained by forming a film with resin particles alone under the conditions described below and measuring the physical properties of the film by a dynamic viscoelasticity measuring method. The dynamic viscoelasticity is measured by a method using, for example, a dynamic viscoelasticity measuring apparatus "Rheogel-E4000" (product name, manufactured by UBM Co., Ltd.).

Conditions

Film thickness: 500 μm, and

Drying: pre-drying at room temperature (25° C.) for 15 hours and then drying at 80° C. for 6 hours and further at 120° C. for 20 minutes.

The resin particles are particles containing a resin. The resin particles are, for example, resin particles contained in a resin emulsion. More specifically, the resin particles may be resin particles having an introduced hydrophilic component necessary for stable dispersion in water (self-dispersible resin particles) or may be resin particles that are dispersed in water by a dispersant.

The resin contained in the resin particles are not particularly limited, and examples thereof include urethane resins, (meth)acrylic resins such as a styrene-(meth)acrylic resin, epoxy resins, polyolefin resins, fluorene resins, rosin-modified resins, terpene resins, polyester resins, polyamide resins, vinyl chloride resins, vinyl chloride-vinyl acetate copolymers, and ethylene-vinyl acetate resins. Among these resins, the resin may be a urethane resin, a (meth)acrylic resin, an epoxy resin, a polyolefin resin, or a styrene-(meth) acrylic resin, in particular, a urethane resin or a styrene-(meth)acrylic resin. The resin may be a urethane resin from the viewpoint of improving the washing fastness properties. These resins may be used alone or in combination of two or more thereof.

The urethane resin is a resin having a urethane bond. Examples of the urethane resin include a polyether urethane resin having a urethane bond and an ether bond in the main chain, a polyester urethane resin having a urethane bond and an ester bond in the main chain, and a polycarbonate urethane resin having a urethane bond and a carbonate bond in the main chain. Among these urethane resins, the urethane resin may be a polycarbonate urethane resin having a urethane bond and a carbonate bond in the main chain. These urethane resins may be used alone or in combination of two or more thereof.

The (meth)acrylic resin is a resin having a component derived from (meth)acrylic acid or (meth)acrylic ester. The (meth)acrylic resin is not particularly limited, and examples thereof include polymers of (meth)acrylic monomers such as (meth)acrylic acid and (meth)acrylic ester and copolymers of a (meth)acrylic monomer and another monomer, which may be an aromatic vinyl monomer, such as styrene, α-methylstyrene, vinyltoluene, 4-t-butylstyrene, chlorostyrene, vinylanisole, or vinylnaphthalene. That is, the (meth) acrylic resin may be a styrene-(meth)acrylic resin.

The resin particles may have an average particle diameter $D_{50}$ of 0.01 μm or more and 0.30 μm or less, 0.01 μm or more and 0.20 μm or less, 0.01 μm or more and 0.15 μm or less, or 0.01 μm or more and 0.100 μm or less. The average particle diameter $D_{50}$ of the resin particles is a value measured by a light-scattering method and can be measured with, for example, a nanotrack particle size distribution measuring apparatus "UPA-EX150 (product name, manufactured Nikkiso Co., Ltd.).

Examples of commercially available resin particles include "SUPERFLEX" series "840" (Tg: 5° C.), "300" (Tg: −42° C., average particle diameter: 0.07 μm), "420" (Tg: −10° C., average particle diameter: 0.01 μm), "420NS" (Tg: −10° C., average particle diameter: 0.01 μm), "460" (Tg: −21° C., average particle diameter: 0.04 μm), "460S" (Tg: −28° C., average particle diameter: 0.03 μm), "470" (Tg: −31° C., average particle diameter: 0.05 μm), "500M" (Tg: −39° C., average particle diameter: 0.14 μm), "650" (Tg: −17° C., average particle diameter: 0.01 μm), and "740" (Tg: −34° C., average particle diameter: 0.20 μm) (all are product names, manufactured by DKS Co., Ltd.), "TAKELAC" series "WS-6021" (Tg: −60° C.) (product name, manufactured by Mitsui Chemicals, Inc.), and "Movinyl 6960" (Tg: −23° C.) (product name, manufactured by Nippon Synthetic Chemical Industry Co., Ltd.).

In the ink composition of the present embodiment, the content of the resin particles is 5.0 mass % or more based on the total amount of the ink composition. Within this range of the content, the printed fabric has excellent washing fastness properties. The content of the resin particles may be 6.5 mass % or more, 7.0 mass % or more, or 8.0 mass % or more. Within such a range, the printed fabric can have further improved washing fastness properties.

The content of the resin particles may be 20.0 mass % or less, 15.0 mass % or less, or 10.0 mass % or less. Within such a range, the printed fabric can have further improved texture.

White Pigment

The ink composition of the present embodiment contains a white pigment. That is, the ink composition is a white ink composition. The white pigment used in the present embodiment is not particularly limited and may be a white pigment made of an inorganic material, and examples thereof include C.I. Pigment White 1 which is basic lead carbonate, C.I. Pigment White 4 which is composed of zinc oxide, C.I. Pigment White 5 which is composed of a mixture of zinc sulfide and barium sulfate, C.I. Pigment White 6 which is composed of titanium dioxide, C.I. Pigment White 6:1 which is composed of titanium dioxide and containing another metal oxide, C.I. Pigment White 7 which is composed of zinc sulfide, C.I. Pigment White 18 which is composed of calcium carbonate, C.I. Pigment White 19 which is composed of clay, C.I. Pigment White 20 which is composed of mica titanium, C.I. Pigment White 21 which is composed of barium sulfate, C.I. Pigment White 22 which is composed of gypsum, C.I. Pigment White 26 which is composed of magnesium oxide/silicon dioxide, C.I. Pigment White 27 which is composed of silicon dioxide, and C.I. Pigment White 28 which is composed of anhydrous calcium silicate. Among these pigments, titanium oxide (C.I. Pigment White 6) may be used because of, for example, its excellent color development properties and latency.

The ink composition of the present embodiment may contain the white pigment in an amount of 5.0 mass % or more. When the white pigment is contained in an amount of 5.0 mass % or more, printed matter having excellent whiteness is obtained. The content of the white pigment may be 6.0 mass % or more based on the total amount of the ink composition and may be 6.0 mass % or more and 20.0 mass % or less, 7.0 mass % or more and 15.0 mass % or less, or 8.0 mass % or more and 10.0 mass % or less, from the viewpoint of improving the whiteness.

Water

The ink composition of the present embodiment contains water. The water is not particularly limited, and examples thereof include pure water, such as deionized water, ultrafiltration water, reverse osmosis water, and distilled water, and ultrapure water.

The content of water in the ink composition of the present embodiment may be 10.0 mass % or more based on the total amount of the ink composition and may be 10.0 mass % or more and 80.0 mass % or less, 15.0 mass % or more and 75.0 mass % or less, or 20.0 mass % or more and 70.0 mass % or less.

Water Soluble Organic Solvent

The ink composition of the present embodiment may further contain a water soluble organic solvent from the viewpoint of viscosity control and moisturizing effect.

The water soluble organic solvent is not particularly limited, and examples thereof include glycerol, lower alcohols, glycols, acetins, glycol derivatives, 1-methyl-2-pyrrolidone, β-thiodiglycol, and sulfolane.

The lower alcohols are not particularly limited, and examples thereof include methanol, ethanol, 1-propanol, isopropanol, 1-butanol, 2-butanol, isobutanol, 2-methyl-2-propanol, and 1,2-hexanediol.

The glycols are not particularly limited, and examples thereof include ethylene glycol, diethylene glycol, triethylene glycol, tetraethylene glycol, pentaethylene glycol, propylene glycol, dipropylene glycol, and tripropylene glycol.

The acetins are not particularly limited, and examples thereof include monoacetin, diacetin, and triacetin.

The glycol derivatives are not particularly limited, and examples thereof include triethylene glycol monomethyl ether, triethylene glycol monoethyl ether, triethylene glycol monopropyl ether, triethylene glycol monobutyl ether, tetraethylene glycol monomethyl ether, tetraethylene glycol monoethyl ether, tetraethylene glycol dimethyl ether, and tetraethylene glycol diethyl ether. These water soluble organic solvents may be used alone or in combination of two or more thereof.

Among these water soluble organic solvents, glycerol or a lower alcohol, in particular, glycerol or 1,2-hexanediol may be used.

When the ink composition of the present embodiment contains a water soluble organic solvent, the content thereof may be 1.0 mass % or more and 50.0 mass % or less, 5.0 mass % or more and 40.0 mass % or less, or 10.0 mass % or more and 30.0 mass % or less based on the total amount of the ink composition.

The ink composition of the present embodiment shows excellent discharge stability when used in combination with a jet head having a predetermined circulation return passage. Accordingly, high discharge stability can be easily secured even if the content of the water soluble organic solvent for keeping the nozzle-moisturizing effect good is low. Specifically, the content of the water soluble organic solvent having a normal boiling point of 280° C. or more, such as glycerol, may be 18.0 mass % or less, 10.0 mass % or less, or 8.0 mass % or less based on the total amount of the ink composition. The discharge stability of the ink composition can be kept good even by such a content, and due to the low content of the organic solvent having a high boiling point, drying tends to be easy and the washing fastness properties tend to be good. In addition, the content of the water soluble organic solvent having a normal boiling point of 280° C. or more may be 1.0 mass % or more or 5.0 mass % or more based on the total amount of the ink composition. In such a content, the ink composition can have good discharge stability.

Surfactant

The ink composition of the present embodiment may further contain a surfactant from the viewpoint that the ink composition can be stably discharged by an ink jet recording system and that permeation of the ink composition can be appropriately controlled. The surfactant is not particularly limited, and examples thereof include acetylene glycol surfactants, fluorine surfactants, and silicone surfactants.

The acetylene glycol surfactant is not particularly limited, and examples thereof include 2,4,7,9-tetramethyl-5-decyne-4,7-diol and alkylene oxide adducts of 2,4,7,9-tetramethyl-5-decyne-4,7-diol and 2,4-dimethyl-5-decyne-4-ol and alkylene oxide adducts of 2,4-dimethyl-5-decyne-4-ol.

The fluorine surfactant is not particularly limited, and examples thereof include perfluoroalkyl sulfonates, perfluoroalkyl carbonates, perfluoroalkyl phosphates, perfluoroalkyl ethylene oxide adducts, perfluoroalkyl betaines, and perfluoroalkylamine oxide compounds.

The silicone surfactant is not particularly limited, and examples thereof include polysiloxane compounds and polyether-modified organosiloxanes. These surfactants may be used alone or in combination of two or more thereof.

When the ink composition of the present embodiment contains a surfactant, the content thereof may be 0.1 mass % or more and 5.0 mass % or less, 0.2 mass % or more and 3.0 mass % or less, or 0.2 mass % or more and 1.0 mass % or less based on the total amount of the ink composition.

The ink composition of the present embodiment may appropriately contain various additives as other additives, such as a pH adjuster, a softening agent, a wax, a dissolution aid, a viscosity modifier, an antioxidant, a fungicide/preservative, an antifungal agent, a corrosion inhibitor, and a chelating agent (for example, sodium ethylenediaminetetraacetate) for capturing a metal ion that affects dispersion.

In the ink composition of the present embodiment, the solid content concentration may be 8.0 mass % or more, 10.0 mass % or more, 12.0 mass % or more, or 15.0 mass % or more. When the solid content concentration is within such a range, the washing fastness properties and the whiteness are further improved. The solid content concentration may be 30.0 mass % or less, 25.0 mass % or less, or 20.0 mass % or less. When the solid content concentration is within such a range, the discharge stability and the texture are further improved. Incidentally, the solid content concentration means the content of components other than solvents including water.

In the present embodiment, the ink composition is prepared by mixing each of the components described above in an arbitrary order and removing impurities by, for example, filtration as needed. As the method for mixing the components, materials may be successively added to a container equipped with a stirrer, such as a mechanical stirrer or a magnetic stirrer, and stirred and mixed. As the filtration, for example, centrifugation or filter filtration can be performed as needed.

Ink Jet Textile Printing Method

The ink jet textile printing method of the present embodiment uses an ink jet recording apparatus including a liquid jet head according to the present embodiment. The ink jet textile printing method of the present embodiment includes discharge of the above-described ink composition from the nozzle (hereinafter, also referred to as "discharge step") and circulation of at least a part of the ink composition into the above-described pressure chamber from the circulation return passage (hereinafter, also referred to as "circulation step"). Incidentally, the ink composition is the ink composition according to the present embodiment described above. According to the above configuration, it is possible to provide an ink jet textile printing method that prepares printed matter having excellent washing fastness properties and texture with excellent discharge stability of the ink composition while giving high whiteness.

Incidentally, the discharge step and the circulation step may be simultaneously performed or may be sequentially performed. For example, in textile printing, the discharge step and the circulation step are simultaneously performed, but at the time when the discharge step is suspended, only the circulation step may be performed.

Discharge Step

The ink jet textile printing method of the present embodiment discharges the above-described ink composition from a nozzle. The discharged ink composition adheres to, for example, fabric. That is, in the ink jet textile printing method of the present embodiment, fabric may be used as a recording medium. In the discharge step, droplets of the ink composition discharged from the above-described liquid jet head 3 (see FIG. 1) are landed on at least a part of the fabric. In the present embodiment, when the ink jet method is used in the discharge step, for example, a plate that is necessary for analog textile printing, such as screen textile printing, is unnecessary, the application to multi-type small-quantity production becomes easy, and also high-definition images, text, patterns, colors, etc. can be formed.

Fabric

The fibers constituting the fabric are not particularly limited, and examples thereof include natural fibers, such as cotton, hemp, wool, and silk; synthetic fibers, such as polypropylene, polyester, acetate, triacetate, polyamide, and polyurethane; biodegradable fibers, such as polylactic acid; and blended fibers thereof.

The fabric may be any of the above-mentioned fibers formed into, for example, any of woven fabric, knitted fabric, and non-woven fabric. In addition, the weight per unit area of the fabric used in the present embodiment is not particularly limited and may be, for example, 1.0 oz or more and 10.0 oz or less, 2.0 oz or more and 9.0 oz or less, 3.0 oz or more and 8.0 oz or less, or 4.0 oz or more and 7.0 oz or less. When the weight per unit area of the fabric is within such a range, satisfactory recording can be performed. Furthermore, the ink jet recording method according to the present embodiment can be applied to multiple types of fabric having different weights per unit area and can perform good printing.

In the present embodiment, examples of the form of the fabric include cloth, garments, and other clothing ornaments. Examples of the cloth include woven fabric, knitted fabric, and non-woven fabric. Examples of the garments and other clothing ornaments include sewn T-shirts, handkerchiefs, scarves, towels, carrier bags; cloth bags, curtains, sheets, and bedspreads; furniture such as wallpaper; and cut or uncut cloth as parts before sewing. Examples of these forms of fabric include a long one wound in a roll shape, one cut into a predetermined size, and one having a product shape. Incidentally, the fabric may be one to which a process liquid is applied in advance.

As the fabric, cotton fabric colored in advance with a dye may be used. Examples of the dye with which fabric is dyed in advance include water-soluble dyes, such as acid dyes and basic dyes; disperse dyes combined with dispersants; and reactive dyes. When cotton fabric is used, a reactive dye suitable for dyeing cotton may be used.

Process Liquid

In the present embodiment, the fabric may be treated with a process liquid composition (hereinafter, also simply referred to as "process liquid"). The process liquid composition is used by previously adhering to fabric as a base material of printed matter in ink jet textile printing and contains, for example, a cationic compound and the above-mentioned water and organic solvent.

The cationic compound has a function of aggregating the components in the ink composition. Accordingly, when the ink composition adheres to the fabric to which the process liquid adhered, the cationic compound enhances aggregation of the pigment particles and increases the viscosity of the ink composition to inhibit absorption into apertures or inside of the fibers constituting the fabric. Thus, since the cationic compound retains the ink composition on the surface of fabric, the whiteness of the ink composition in the printed matter is improved. In addition, blur and bleeding are inhibited.

The cationic compound is not particularly limited, and examples thereof include multivalent metal salts, such as calcium salts and magnesium salts; cationic resins, such as cationic urethane resin, olefin resin, and allylamine resin; cationic surfactants; inorganic acids; and organic acids. The salt of the multivalent metal salt is not particularly limited, and examples thereof include carboxylates, such as formate, acetate, and benzoate; sulfates; nitrates; chlorides; and thiocyanates. Among these compounds, multivalent metal salts may be used from the viewpoint of improving the color development properties of the pigment and being suitable for cotton fabric. These cationic compounds may be used alone or in combination of two or more thereof.

The content of the cationic compound is not particularly limited and may be 0.1 mass % or more and 40.0 mass % or less, 2.0 mass % or more and 25.0 mass % or less, or 5.0 mass % or more and 10.0 mass % or less based on the total amount of the process liquid. When the content of the cationic compound is within the range above, precipitation or separation of the cationic compound in the process liquid is inhibited, and aggregation of the pigment and the resin particles in the ink composition is accelerated to inhibit absorption into apertures or inside of the fibers constituting the fabric. Consequently, the phenomenon that the color material penetrates in the rear surface direction of the printing surface is reduced, and the color development properties of the printed matter are improved.

The fabric may be treated with a process liquid. When the fabric is treated with a process liquid, the components, such as the pigment, contained in the ink composition react with the cationic compound in the process liquid and aggregate in the vicinity of the surface of the fabric 2. Consequently, the pigment less likely penetrates in the inside direction of the fabric 2, and the whiteness of the ink composition is further improved.

The method for adhering the process liquid may be any method that can adhere the process liquid to at least a partial region of fabric and is not particularly limited, and examples thereof include immersion coating immersing fabric in the process liquid; roller coating using a brush, roller, spatula, roll coater, etc. for adhesion of the process liquid; spray coating jetting the process liquid with a spray device, etc.; and ink jet coating using an ink jet method for adhesion of the process liquid. In particular, immersion coating, roller coating, and spray coating can quickly perform adhesion of the process liquid with an apparatus having a simple structure and may be used.

In the discharge step, the amount of the ink composition adhering to the fabric 2 may be 10 $g/m^2$ or more and 200 $g/m^2$ or less, or 15 $g/m^2$ or more and 170 $g/m^2$ or less, per unit area of the fabric 2. When the adhesion amount of the ink composition is within the range above, the whiteness of, for example, an image formed by the textile printing is improved. In addition, the drying properties of the ink composition adhered to the fabric 2 are secured, and generation of blur in, for example, an image is reduced. When an undercoat is first formed with, for example, a white ink composition on previously colored fabric, the amount of the adhering white ink composition may be higher than the above-mentioned amount.

Circulation Step

The ink jet textile printing method of the present embodiment includes circulating at least a part of the ink composition from the circulation return passage to the pressure chamber. Incidentally, in the present embodiment, the ink composition flows by including the circulation step to inhibit clogging due to aggregates of the solid content, such as the white pigment and the resin particles, and to improve the discharge stability. Thus, since the discharge stability can be secured even if the concentration of the white pigment is increased, excellent whiteness is obtained.

In the circulation step, the rate of the amount of the circulating ink composition based on the total amount of the ink composition supplied from the pressure chamber to the nozzle (hereinafter, also simply referred to as "circulation rate") may be 50 mass % or more, 60 mass % or more, 70 mass % or more, or 75 mass % or more. When the circulation rate is within such a range, the discharge stability can be further improved. The upper limit of the circulation rate is not particularly limited and may be 99 mass % or less, 98 mass % or less, 95 mass % or less, or 90 mass % or less.

Heating Step

The ink jet textile printing method of the present embodiment may further include heating of the ink composition adhered to the fabric 2 (hereinafter, also referred to as "heating step") after the discharge step.

The heating method is not particularly limited, and examples thereof include a heat press method, a normal-pressure steam method, a high-pressure steam method, and a thermofix method. The heat source for heating is not particularly limited, and examples thereof include an infrared lamp. The heating temperature may be any temperature at which the resin particles in the ink composition are fused and the medium, such as water, volatilizes and may be about 100° C. or more and about 200° C. or less, 110° C. or more and 190° C. or less, or 120° C. or more and 180° C. or less. Here, the heating temperature in the heating step is the surface temperature of the image or the like formed on the fabric 2. The heating time is not particularly limited and is, for example, 30 seconds or more and 20 minutes or less.

Washing Step

The ink jet textile printing method of the present embodiment may further include washing the recording medium to which the ink composition adhered (hereinafter, also referred to as "washing step") after the heating step. The washing step can effectively remove the coloring agent not dyeing the fibers. The washing step may be performed using, for example, water, and may perform soaping treatment as needed. The soaping treatment is not particularly limited, and examples thereof include a method of washing away unfixed pigment with a hot soap solution or the like.

EXAMPLES

The present disclosure will now be more specifically described by examples and comparative examples but is not limited to the following examples.

Ink Jet Textile Printing Method

Examples 1 to 7 and Comparative Examples 1 to 5

Preparation of Ink Composition

The materials in the compositions shown in Table 1 were mixed and sufficiently stirred to prepare each ink composition. Specifically, the materials were uniformly mixed, and undissolved matter was removed by a membrane filter with a pore size of 5 μm to prepare each ink composition. Incidentally, the numerical values in Table 1 represent mass % based on the total amount of the ink composition. The numerical values regarding resin particles shown in Table 1 are values in terms of solid content. The resulting ink compositions were evaluated by the methods for evaluation described below.

Preparation of Process Liquid and Treatment of Fabric

Deionized water was added to calcium nitrate tetrahydrate (Ca: 17 mass %, 20.0 parts by mass) and acetylene glycol surfactant "Olfine E1010" (product name, manufactured by Nissin Chemical Industry Co., Ltd., 0.5 parts by mass) to make the total 100 parts by mass, and the mixture was stirred to prepare a process liquid.

T-shirt cloth (manufactured by Hanesbrands Inc., heavyweight black cotton 100 mass %) was prepared as fabric, and the ink composition prepared above was uniformly applied to the cloth with a roller at an amount of 18 to 20 g for A4-size 210×297 mm. After application of the process liquid, heat treatment with a heat press was performed at 160° C. for 1 minute.

Ink Jet Textile Printing Method

The ink composition prepared above was allowed to adhere to the treated fabric by an ink jet method using an ink jet printer (product name "PX-G930", manufactured by Seiko Epson Corporation) provided with a circulation return passage shown in, for example, FIG. 2 to print an image. The printed pattern (image) was a solid image having a resolution of 1440×720 dpi and formed in a printing range of 210×297 mm. Subsequently, the detailed printing conditions are as shown in each evaluation item.

During printing, the ink composition was circulated at a circulation amount of 70 vol % when the "Head" in the table is under "Circulation" and at a circulation amount of 0 vol % when the "Head" is under "Non-Circulation".

Evaluation Test

Discharge Stability

A chart of a solid image filling 5% of an area of 210×297 mm was continuously printed using the above-described ink jet printer on 15 pieces of white cotton broad cloth at a resolution of 1,440×720 dpi. The resulting images were observed to verify whether discharge irregularity or nozzle omission was present or not, and the discharge stability was evaluated based on the nozzle omission during the continuous printing. The evaluation criteria are as shown below. The results of evaluation are shown in Table 1. When the evaluation result is A, it can be determined that a good result has been obtained.

A: No discharge irregularity was observed,

B: Discharge irregularity was observed, and

C: Discharge irregularity was observed, and a nozzle omitting discharge was present.

Washing Fastness Properties

Each of the ink compositions was discharged onto one surface of the pretreated fabric as an object to be treated at an application density of 39 mg/inch$^2$ with the above-described ink jet printer. Subsequently, the fabric to which the ink composition adhered was subjected to heating and drying treatment at 160° C. for 5 minutes using a conveyor dryer "Economax D" manufactured by M&R and was then cooled to 25° C. to obtain textile printed matter. The resulting printed fabric was sufficiently dried and was evaluated by a test for washing fastness properties. The test for washing fastness properties was performed in accordance with 2A and 3A of AATCC61, and visual evaluation was performed based on the following evaluation criteria. Incidentally, "2A" below means washing at 25° C., and "3A" means washing at 60° C. The evaluation criteria are as shown below. The results of evaluation are shown in Table 1. When the evaluation result is A or higher, it can be determined that a good result has been obtained.

AA: No falling of coating film in the recorded portion was observed under both conditions 2A and 3A, A: No falling of coating film was observed under condition 2A, but some falling was observed under condition 3A, and B: Falling of coating film was observed under condition 2A.

Whiteness

The printed fabric prepared in the evaluation of "Washing fastness properties" above was subjected to measurement of L* value in a CIE/L*a*b* color system with a colorimeter "Gretag Macbeth Spectrolino" (product name, manufactured by X-Rite, Inc.). The evaluation criteria are as shown below. The results of evaluation are shown in Table 1. When the evaluation result is A or higher, it can be determined that a good result has been obtained.

AA: The L* value was 94 or more,

A: The L* value was 92 or more and less than 94,

B: The L* value was 90 or more and less than 92, and

C: The L* value was less than 90.

Texture

The printed fabric prepared in the evaluation of "washing fastness properties" above was subjected to sensory evaluation of texture. Specifically, arbitrary five judges answered either that "the hand feeling is substantially the same as the original" or that "the printed fabric is stiff, and the original hand feeling of the fabric is impaired", and evaluation was performed based on the following criteria. When the evaluation result is A, it can be determined that a good result has been obtained.

A: Four or more judges answered that "the hand feeling was substantially the same as the original", B: Three judges answered that "the hand feeling was substantially the same as the original", and C: Two or less judges answered that "the hand feeling was substantially the same as the original".

TABLE 1

| | | | Example | | | | | | | Comparative Example | | | | |
|---|---|---|---|---|---|---|---|---|---|---|---|---|---|---|
| | | | 1 | 2 | 3 | 4 | 5 | 6 | 7 | 1 | 2 | 3 | 4 | 5 |
| Ink composition (mass %) | White pigment*1 | Titanium oxide pigment dispersion (solid content amount: 40%) | 20.0 (8.0) | 12.5 (5.0) | 20.0 (8.0) | 12.5 (5.0) | 20.0 (8.0) | 20.0 (8.0) | 12.5 (5.0) | 20.0 (8.0) | 12.5 (5.0) | 12.5 (5.0) | 12.5 (5.0) | 10.0 (4.0) |
| | Resin particle*2 | Resin emulsion R1 (Tg < 6° C.) | 9.0 | 9.0 | 5.0 | 5.0 | — | — | 5.0 | 9.0 | 5.0 | 4.0 | — | 5.0 |
| | | Resin emulsion R2 (Tg ≥ 6° C.) | — | — | — | — | — | — | — | — | — | — | 9.0 | — |
| | | Resin emulsion R3 (Tg < 6° C.) | — | — | — | — | 9.0 | — | — | — | — | — | — | — |
| | | Resin emulsion R4 (Tg < | — | — | — | — | — | 9.0 | — | — | — | — | — | — |

TABLE 1-continued

| | | | Example | | | | | | | Comparative Example | | | | |
|---|---|---|---|---|---|---|---|---|---|---|---|---|---|---|
| | | | 1 | 2 | 3 | 4 | 5 | 6 | 7 | 1 | 2 | 3 | 4 | 5 |
| | | 6° C.) | | | | | | | | | | | | |
| | Water-soluble organic solvent | Glycerol | 18.0 | 21.0 | 21.0 | 25.0 | 18.0 | 18.0 | 10.0 | 18.0 | 25.0 | 26.0 | 21.0 | 22.0 |
| | | 1,2-Hexanediol | 2.0 | 2.0 | 2.0 | 2.0 | 2.0 | 2.0 | 2.0 | 2.0 | 2.0 | 2.0 | 2.0 | 2.0 |
| | Surfactant | BYK-348 | 0.5 | 0.5 | 0.5 | 0.5 | 0.5 | 0.5 | 0.5 | 0.5 | 0.5 | 0.5 | 0.5 | 0.5 |
| | Potassium hydroxide | | 0.1 | 0.1 | 0.1 | 0.1 | 0.1 | 0.1 | 0.1 | 0.1 | 0.1 | 0.1 | 0.1 | 0.1 |
| | Deionized water | | Balance | Balance | Balance | Balance | Balance | Balance | Balance | Balance | Balance | Balance | Balance | Balance |
| Head | | | Circulation | Circulation | Circulation | Circulation | Circulation | Circulation | Circulation | Non-Circulation | Non-Circulation | Circulation | Circulation | Circulation |
| Evaluation | Discharge stability | | A | A | A | A | A | A | A | C | B | A | B | A |
| | Printed fabric: Washing fastness properties | | AA | AA | A | A | A | A | AA | AA | A | B | A | A |
| | Printed fabric: Whiteness | | AA | A | AA | A | AA | AA | A | AA | A | A | A | B |
| | Printed fabric: Texture | | A | A | A | A | A | A | A | A | A | A | B | A |

*1The value in parentheses is in terms of solid content.
*2The value is in terms of solid content.

Resin emulsion R1: "SUPERFLEX 840" (product name, manufactured by DKS Co., Ltd., urethane resin emulsion, Tg: 5° C., solid content concentration: 30 mass %), Resin emulsion R2: "TAKELACW-6021" (product name, manufactured by Mitsui Chemicals, Inc., urethane resin emulsion, Tg: 25° C., solid content concentration: 30 mass %), Resin emulsion R3: "SUPERFLEX 470" (product name, manufactured by DKS Co., Ltd., urethane resin emulsion, Tg: −31° C., solid content concentration: 38 mass %), Resin emulsion R4: "Movinyl 6960" (product name, manufactured by Nippon Synthetic Chemical Industry Co., Ltd., styrene-acrylic resin emulsion, Tg: −23° C., solid content concentration: 45 mass %), and BYK-348: silicone surfactant "BYK-348" (product name, manufactured by BYK-Chemie Japan K.K.).

The results of Examples and Comparative Examples demonstrate that according to the ink jet recording apparatus and the ink jet textile printing method of the present embodiment, printed matter having excellent washing fastness properties and texture is obtained with excellent discharge stability of the ink composition while having high whiteness.

Comparison between the results of Example 1 and Comparative Example 1 and comparison between the results of Example 3 and Comparative Example 2 demonstrate that when the apparatus has a circulation return passage, excellent discharge stability is obtained.

Comparison between the results of Examples 1 and 2 and Comparative Example 5 demonstrates that when the content of a white pigment is 5.0 mass % or more, excellent whiteness is obtained.

Comparison between the results of Examples 2 and 4 and Comparative Example 3 demonstrates that when the content of resin particles is 5.0 mass % or more, excellent washing fastness properties are obtained.

Comparison between the results of Example 2 and Comparative Example 4 demonstrates that when the resin particles have a glass transition temperature of less than 6° C., excellent texture is obtained.

Comparison between the results of Example 1 and Example 5 demonstrates that when the resin particles have a glass transition temperature of −25° C. or more, excellent washing fastness properties are obtained.

Comparison between the results of Example 1 and Example 6 demonstrates that when the resin particles contain a urethane resin, excellent washing fastness properties are obtained.

Comparison between the results of Example 1 and Example 7 demonstrates that even if the content of glycerol is low, the results show high discharge stability, and also excellent washing fastness properties are obtained.

What is claimed is:

1. An ink jet recording apparatus comprising:

an ink composition, and a liquid jet head including a nozzle for discharging the ink composition, wherein the ink composition is a textile printing ink composition containing a resin particle, a white pigment, and water;

the resin particle is contained in an amount of 5.0 mass % or more based on the total amount of the ink composition;

the white pigment is contained in an amount of 5.0 mass % or more based on the total amount of the ink composition;

the resin particle has a glass transition temperature of less than 6° C.; and the liquid jet head includes a first flow path substrate and a second flow path substrate that collectively define a pressure chamber to which the ink composition is supplied, and a nozzle plate coupled to the first flow path substrate that defines a nozzle in communication with the pressure chamber for discharging the ink composition, the first flow path substrate and the nozzle plate collectively defining a circulation return passage in communication with the pressure chamber configured to circulate the ink composition in the pressure chamber, and the pressure chamber communications with the circulation return passage via an exhaust passage in the form of a groove formed in the nozzle plate that faces the first flow path substrate and is configured to flow the ink composition between the pressure chamber and the circulation return passage.

2. The ink jet recording apparatus according to claim 1, wherein the resin particle has a glass transition temperature of −25° C. or more and less than 6° C.

3. The ink jet recording apparatus according to claim 1, wherein the ink composition contains the white pigment in an amount of 6.0 mass % or more based on the total amount of the ink composition.

4. The ink jet recording apparatus according to claim 1, wherein the ink composition has a solid content concentration of 12.0 mass % or more.

5. The ink jet recording apparatus according to claim 1, wherein the resin particle contains a urethane resin.

6. The ink jet recording apparatus according to claim 1, wherein the white pigment is titanium oxide.

7. An ink jet textile printing method using an ink jet recording apparatus that includes a liquid jet head including a first flow path substrate and a second flow path substrate that collectively define a pressure chamber to which the ink composition is supplied, and a nozzle plate coupled to the first flow path substrate the defines a nozzle in communication with the pressure chamber for discharging the ink composition, the first flow path substrate and the nozzle plate collectively defining a circulation return passage in communication with the pressure chamber configured to circulate the ink composition in the pressure chamber, and the pressure chamber communicates with the circulation return passage via an exhaust passage in the form of a groove formed in the nozzle plate that faces the first flow path substrate and is configured to flow the ink composition between the pressure chamber and the circulation return passage, the method comprising:

discharging the ink composition from the nozzle; and circulating at least a part of the ink composition from the circulation return passage to the pressure chamber, wherein the ink composition is a textile printing ink composition containing a resin particle, a white pigment, and water;

the resin particle is contained in an amount of 5.0 mass % or more based on the total amount of the ink composition;

the white pigment is contained in an amount of 5.0 mass % or more based on the total amount of the ink composition; and the resin particle has a glass transition temperature of less than 6° C.

* * * * *